US009955546B1

(12) United States Patent
Lu et al.

(10) Patent No.: US 9,955,546 B1
(45) Date of Patent: Apr. 24, 2018

(54) AUTOMATED ENVIRONMENTAL CONTROL OF COLOR TEMPERATURE USING FULL SPECTRUM COLOR CHANGING LIGHT EMITTING DIODES

(71) Applicant: SPAWAR Systems Center Pacific, San Diego, CA (US)

(72) Inventors: Ryan P. Lu, San Diego, CA (US); Aaron J. Lebsack, San Diego, CA (US); Ayax D. Ramirez, Chula Vista, CA (US); Bienvenido Melvin L. Pascoguin, La Mesa, CA (US)

(73) Assignee: The United States of America as represented by Secretary of the Navy, Washington, DC (US)

( * ) Notice: Subject to any disclaimer, the term of this patent is extended or adjusted under 35 U.S.C. 154(b) by 0 days.

(21) Appl. No.: 15/379,253

(22) Filed: Dec. 14, 2016

(51) Int. Cl.
*H05B 37/02* (2006.01)
*H05B 33/08* (2006.01)

(52) U.S. Cl.
CPC ..... *H05B 33/0872* (2013.01); *H05B 33/0848* (2013.01); *H05B 33/0854* (2013.01); *H05B 33/0866* (2013.01); *H05B 37/0218* (2013.01); *H05B 37/0272* (2013.01)

(58) Field of Classification Search
None
See application file for complete search history.

(56) References Cited

U.S. PATENT DOCUMENTS

| | | | | |
|---|---|---|---|---|
| 7,489,089 | B2 * | 2/2009 | Gandhi | H05B 33/0857 315/129 |
| 7,884,556 | B2 * | 2/2011 | Gandhi | H05B 33/0857 315/291 |
| 9,060,409 | B2 * | 6/2015 | Bowers | H05B 33/0863 |
| 9,089,032 | B2 * | 7/2015 | Bowers | H05B 33/0863 |
| 9,530,362 | B2 * | 12/2016 | Chen | G09G 3/2003 |
| 9,648,696 | B2 * | 5/2017 | Weaver | H05B 33/0869 |
| 2009/0121651 | A1 * | 5/2009 | Gandhi | H05B 33/0863 315/291 |
| 2010/0141571 | A1 | 6/2010 | Chiang et al. | |
| 2012/0219306 | A1 * | 8/2012 | Shiomichi | G03G 15/5062 399/15 |
| 2012/0262071 | A1 | 10/2012 | Briggs | |
| 2012/0268538 | A1 * | 10/2012 | Kondo | B41J 2/155 347/102 |
| 2013/0257835 | A1 | 10/2013 | Bell | |

(Continued)

OTHER PUBLICATIONS

"Anova Pro User Guide" (http://www.rotolight.com/pdf/ANOVAPRO_Userguide.pdf).

(Continued)

*Primary Examiner* — Vibol Tan
(74) *Attorney, Agent, or Firm* — SPAWAR Systems Center Pacific; Kyle Eppele

(57) ABSTRACT

A color-changing lighting system includes a color temperature meter for determining a color temperature of visible light within an environment. The color-changing lighting system also includes a microprocessor for converting the color temperature of the visible light to red, green, and blue (RGB) values. The color-changing lighting system further includes a light control unit for calibrating a full spectrum color changing light source to output light having the color temperature of the visible light within the environment, according to the RGB values.

15 Claims, 6 Drawing Sheets

(56) References Cited

U.S. PATENT DOCUMENTS

| | | | | |
|---|---|---|---|---|
| 2015/0098709 | A1* | 4/2015 | Breuer | G01C 3/08 398/118 |
| 2016/0180780 | A1* | 6/2016 | Chen | G09G 3/2003 345/207 |
| 2016/0370231 | A1* | 12/2016 | Agahian | G01J 3/50 |

OTHER PUBLICATIONS

"Automatic Monitor Color Temperature Adustment" (https://leam.adafruit.com/automatic-monitor-color-temperature-adjustment/overview).
"How to Convert Temperature (K) to RGB: Algorithm and Sample Code" (http://www.tannerhelland.com/4435/convert-temperature-rgb-algorithm-code/).
"Conversion formulas from RGB to CMYK" (https://forums.adobe.com/thread/428899).
"Blackbody color datafile" (http://www.vendian.org/mncharity/dir3/blackbody/UnstableURLs/bbr_color.html).
"Rotolight Anova" (http://www.rtsphoto.com/untitled-sitepage_51).

* cited by examiner

AUTOMATED ENVIRONMENTAL CONTROL OF COLOR TEMPERATURE USING FULL SPECTRUM COLOR CHANGING LIGHT EMITTING DIODES

STATEMENT OF GOVERNMENT INTEREST

Federally-Sponsored Research and Development

The United States Government has ownership rights in this invention. Licensing inquiries may be directed to Office of Research and Technical Applications, Space and Naval Warfare Systems Center, Pacific, Code 72120, San Diego, Calif., 92152; telephone (619) 553-5118; email: ssc_pac_t2@navy.mil. Reference Navy Case No. 102,746.

BACKGROUND OF THE INVENTION

Field of Invention

This disclosure relates to determining a color temperature of light, and more specifically, this disclosure relates to adjusting a color temperature of output light according to an identified color temperature of an environment.

Description of Related Art

Color temperature is a characteristic of a visible light source that has applications in lighting, photography, video/cinematography, publishing, manufacturing, astrophysics, horticulture, and other fields. The color temperature of the visible light source is defined as the temperature of an ideal black body radiator that radiates light of comparable hue to that of the visible light source. The color temperature of the visible light source is measured utilizing the Kelvin thermodynamic temperature scale, having the unit symbol K.

In conventional photography and other lighting systems/scenarios where accurate color temperatures of visible light are desired, color correcting gels are used to manually adjust the color temperature of a visible light source to match a color temperature of an environment, This is time consuming and is often inaccurate. Post-processing in software is also used to adjust a color temperature of visible light in an image, However, post-processing consumes considerable time, processing, and energy resources. Therefore, a more efficient color temperature adjustment system and method are needed.

BRIEF SUMMARY OF INVENTION

The present disclosure addresses the needs noted above by providing a color-changing lighting system that includes a color temperature meter for determining a color temperature of visible light within an environment. The meter determines the color temperature using any metering method (e.g., by metering direct light, metering reflected light, metering multiple light sources simultaneously, etc.). The color-changing lighting system also includes a microprocessor for converting the color temperature of the visible light to red, green, and blue (RGB) values, The color-changing lighting system further includes a light control unit for calibrating a full spectrum color changing light source to output light having the color temperature of the visible light within the environment, according to the RGB values.

These, as well as other objects, features and benefits will now become clear from a review of the following detailed description, the illustrative embodiments, and the accompanying drawings.

BRIEF DESCRIPTION OF DRAWINGS

The accompanying drawings, which are incorporated in and form a part of the specification, illustrate example embodiments and, together with the description, serve to explain the principles of the invention. In the drawings.

DETAILED DESCRIPTION OF THE INVENTION

Figure 1:
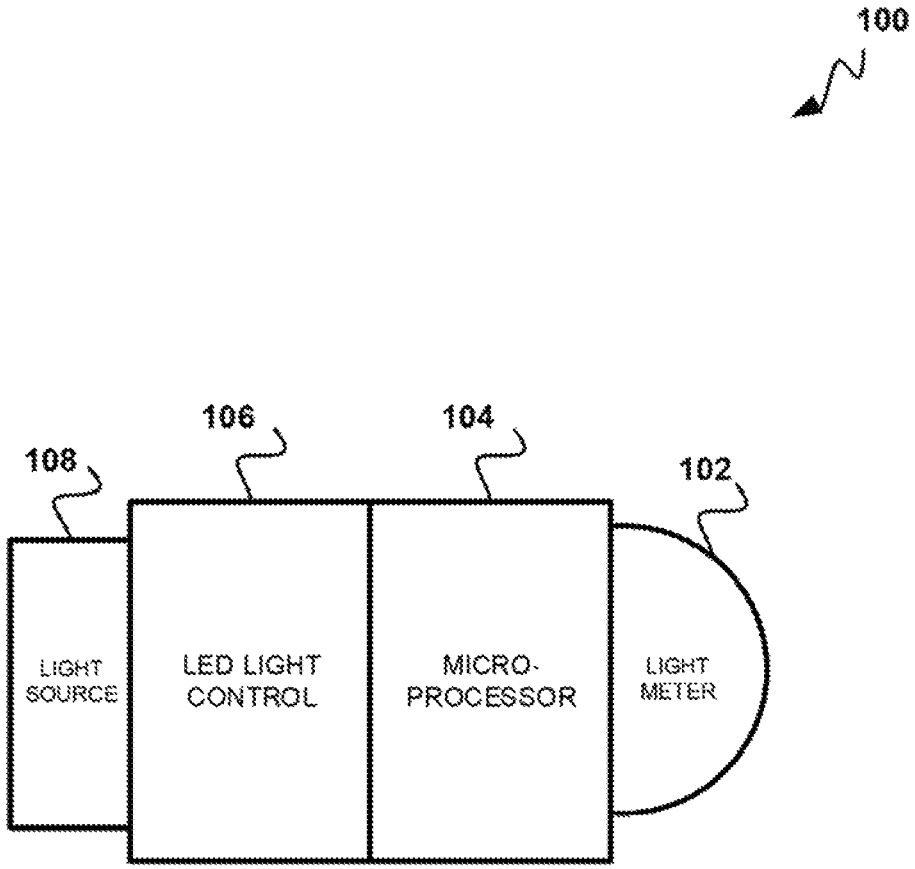
FIG. 1 illustrates a color-changing lighting system where a full spectrum light emitting diode (LED) light source is integrated with a color temperature meter.

In order to automatically adjust a color temperature of provided lighting to match a color temperature of an environment, a light meter measures a color temperature of the visible light within the environment. This color temperature is then convened into red, green, and blue (RGB) values or cyan, magenta, yellow, and black (CMYK) values. The convened RGB or CMYK values are then used to calibrate an available light source to match the color temperature of the environment. FIGS. 1-5 illustrate various different system configurations for implementing this procedure. FIG. 6 describes one example of a method for performing this procedure FIG. 1 shows a color-changing lighting system 100 where a full spectrum LED light source 108 is integrated with a color temperature meter 102. A built-in microprocessor 104 converts a detected color temperature to RGB or CMYK values, and a fill spectrum LED light source 108 Outputs light matching the RGB or CMYK values.

As shown, the color-changing lighting system 100 includes a color temperature meter 102, a microprocessor 104, an LED light control unit 106, and a full spectrum LED light source 108. The color temperature meter 102 is connected to a microprocessor 104. The color temperature meter 102 includes any device capable of measuring a color temperature of visible light. The color temperature meter 102 determines a color temperature of visible light within an environment (e.g., the immediate surroundings of the color temperature meter 102).

The environment includes a physical location surrounding the real-time color-changing lighting system 100. The color temperature includes a characteristic of the visible light detected by the color temperature meter 102. For example, the color temperature includes the temperature of an ideal black-body radiator that radiates light of comparable hue to that of the visible light detected by the color temperature meter 102.

Additionally, the color temperature meter 102 sends the color temperature of the visible light within the environment to the microprocessor 104. The microprocessor includes any computational and control unit that interprets and executes instructions. The microprocessor 104 then converts the color temperature of the visible light into RGB values. For example, the microprocessor 104 implements a prior art conversion algorithm that has been coded into software. The conversion algorithm calculates RGB values based on a given color temperature.

In another example, the microprocessor 104 may further convert the color temperature of the visible light from RGB values into CMYK values. For instance, a control unit for a full spectrum LED may require CMYK values as input. The microprocessor 104 may convert the color temperature of the visible light from RGB values into CMYK values utilizing a prior art conversion algorithm that has been coded into software.

In another example, the microprocessor 104 may convert the color temperature of the visible light into RGB values using a prior art look-up table, For example, predetermined RGB values that create predetermined color temperatures may be saved in a database. The microprocessor 104 may search the database for the color temperature of visible light within the environment, and the results of the search may contain the predetermined RGB values.

Also as shown, the microprocessor 104 is connected to an LED tight control unit 106 that controls a connected full spectrum. LED light source 108. The LED light control unit 106 includes any device for controlling light output by the full spectrum LED light source 108. For example, the LED light control unit 106 calibrates the full spectrum LED light source 108 so that light output by the full spectrum LED light source 108 matches RGB values provided by the LED light control unit 106.

The full spectrum LED light source 108 includes one or more LEDs in one or more housings that electronically output light in response to instructions from the LED light control unit 106. For example, the full spectrum LED light source 108 may emit constant light, strobing light, or a flash of light. All of the above types of light output have a color temperature matching RGB values set by the LED light control unit 106.

In one example, the microprocessor 104 sends the RGB (or CMYK) values for the converted color temperature of the visible light to the LED light control unit 106. The LED light control unit 106 then calibrates the full spectrum LED light source 108 so that its output matches the received RGB (or CMYK) values. The full spectrum LED light source 108 then outputs light matching the received RGB (or CMYK) values.

Therefore, in FIG. 1 the visible light output by the full spectrum LED light source 108 matches the color temperature of visible light within the environment. This eliminates a need to post-process color temperature conflicts within video or pictures taken in the environment. This also eliminates a need to manually adjust visible light output using gels in an attempt to match a color temperature of the environment.

Figure 2:
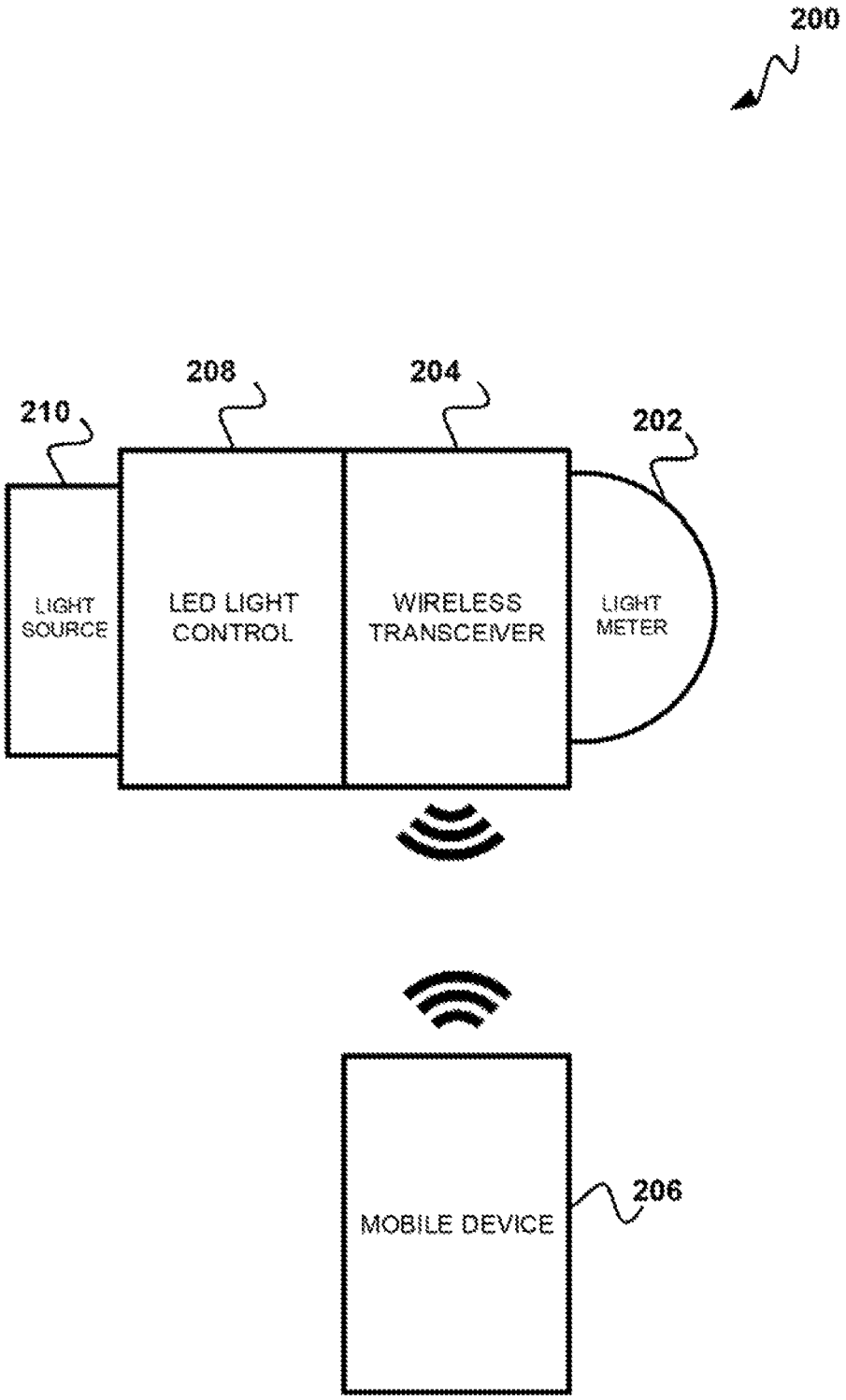
FIG. 2 illustrates a color-changing lighting system where a full spectrum LED light source is integrated with a color temperature meter and, a wireless transceiver.

FIG. 2 shows a color-changing lighting system 200 where a full spectrum LED light source 210 is integrated with a color temperature meter 202 and a wireless transceiver 204. A mobile computing device 206 implements software conversion from color temperature to RGB or CMYK and wirelessly transmits the results of the conversion to the wireless transceiver 204.

As shown, the color-changing, lighting system 200 includes a color temperature meter 202, a wireless transceiver 204, a mobile computing device 206, an LED light control unit 208, and a full spectrum LED light source 210. The color temperature meter 202 is connected to the wireless transceiver 204. The color temperature meter 202 is the same as the color temperature meter described in FIG. 1. The wireless transceiver includes any device that sends and receives data using one or more wireless technologies such as those that implement the various 802.11 and 802.15 protocols maintained by the institute of Electrical and Electronic Engineers. The color temperature meter 202 determines a color temperature of visible light within an environment (measured in K) and sends the color temperature to the wireless transceiver 204.

In response to receiving the color temperature, the wireless transceiver 204 transmits the color temperature to a mobile computing device 206. The mobile computing device 206 includes any mobile device having a processor that interprets and executes received instructions. For example, the mobile computing device 206 may include a smart phone, a tablet computer, a laptop computer, etc. The mobile computing device 206 also communicates with the wireless transceiver 204 using the one or more wireless technologies described above.

The mobile computing device 206 converts the received color temperature into RGB values. For example, the mobile computing device 206 may run a software application that implements a prior art conversion algorithm. The conversion algorithm calculates RGB values based on a given color temperature, as described above in FIG. 1. The mobile computing device 206 may further convert the color temperature of the visible light from RGB values into CMYK values, as described above in FIG. 1. Once the mobile computing device 206 converts the received color temperature into RGB (or CMYK) values, it wirelessly sends the RGB (or CMYK) values back to the wireless transceiver 204.

The wireless transceiver 204 is connected to an LED light control unit 208 that controls a full spectrum LED light source 210. The LED light control unit 208 and the full spectrum LED light source 210 are the same as those described in FIG. 1. The wireless transceiver 204 sends the received RGB (or CMYK) values to the LED light control unit 206. The LED light control unit 206 then calibrates the full spectrum LED light source 208 to match the received. RGB (or CMYK) values. The full spectrum LED light source 208 then outputs light matching the received RGB (or CMYK) values.

Therefore, in FIG. 2 the conversion of a color temperature into RGB values are offloaded to the mobile computing device 206.

Figure 3:
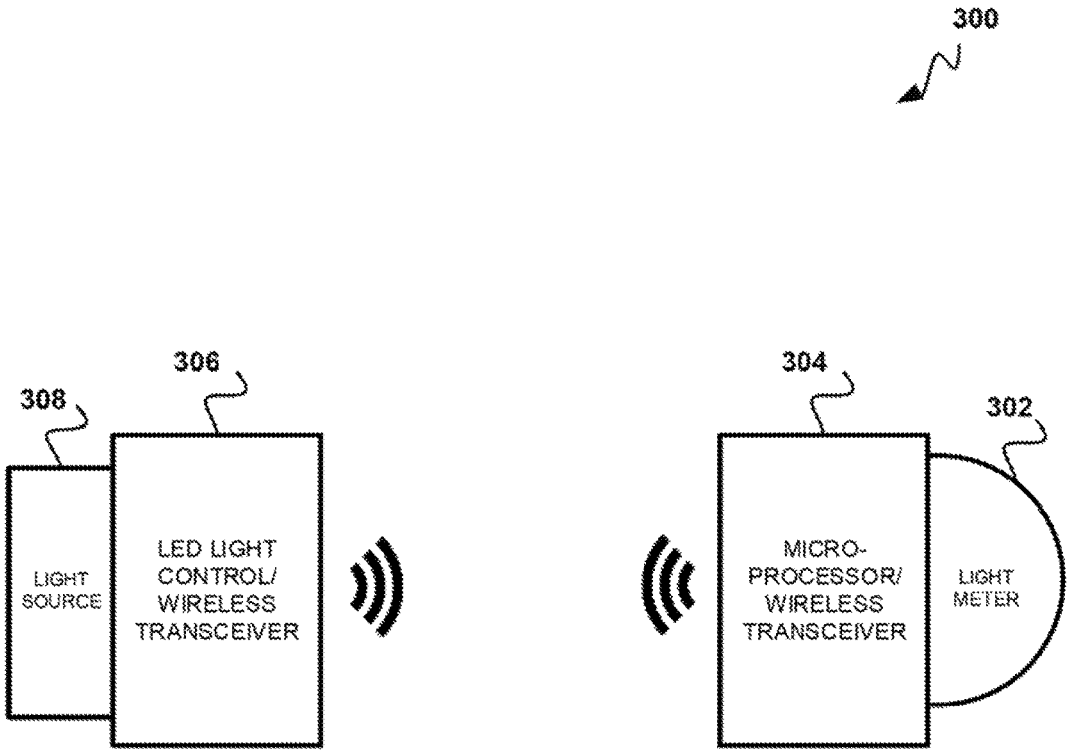
FIG. 3 illustrates a color-changing lighting system where the full spectrum LED light source is separate from a color temperature meter, where both devices include wireless transceivers.

FIG. 3 shows a color-changing lighting system 300 where the full spectrum LED light source 308 is separate from a color temperature meter 302, where both devices include wireless transceivers. The color temperature meter 302 is connected to a microprocessor that implements software conversion from color temperature to RGB or CMYK and wirelessly transmits the results to he output by the full spectrum LED light source 308.

As shown, the color-changing lighting system 300 includes a color temperature meter 302, a combination microprocessor/wireless transceiver 304, a combination LED light control unit/wireless transceiver 306, and a full spectrum LED light source 308. The color temperature meter 302 is connected to the combination microprocessor/wireless transceiver 304. The color temperature meter 302 is the same as the color temperature meter described in FIG. 1. The combination microprocessor/wireless transceiver 304 includes the functionality of the microprocessor described in FIG. 1.

The combination microprocessor/wireless transceiver 304 also includes a transceiver capable of sending and receiving data wirelessly. The color temperature meter 302 determines a color temperature of visible light within an environment (measured in K). The color temperature meter 302 then sends the color temperature to the combination microprocessor/wireless transceiver 304.

In response to receiving the color temperature, the combination microprocessor/wireless transceiver 304 converts the color temperature of the visible light into RGB values. This conversion is performed using, the process described in FIG. 1. The combination microprocessor/wireless transceiver 304 may further convert the color temperature of the visible light from RGB values into CMYK values. This conversion is performed using the process described in FIG. 1.

Once the combination microprocessor/wireless transceiver 304 converts the received color temperature into RGB (or CMYK) values, it wirelessly sends the RGB (or CMYK) values back to a combination LED light control unit/wireless transceiver 306. The combination LED light control unit/wireless transceiver 306 includes the functionality of the LED light control unit described in FIG. 1. The combination LED light control unit/wireless transceiver 306 also includes a transceiver capable of sending and receiving data wirelessly.

The combination LED light control unit/wireless transceiver 306 controls a connected full spectrum LED light source 308. The full spectrum LED light source 308 is the same as that described in FIG. 1. The combination LED light control unit/wireless transceiver 306 calibrates the full spectrum LED light source 308 to match the received RGB (or CMYK) values. The full spectrum LED light source 308 then outputs light matching the received RGB (or CMYK) values.

Therefore, in FIG. 3 the color temperature meter 302 and combination microprocessor/wireless transceiver 304 may be located in a different area than the combination microprocessor/wireless transceiver 304 and full spectrum LED light source 308.

Figure 4:
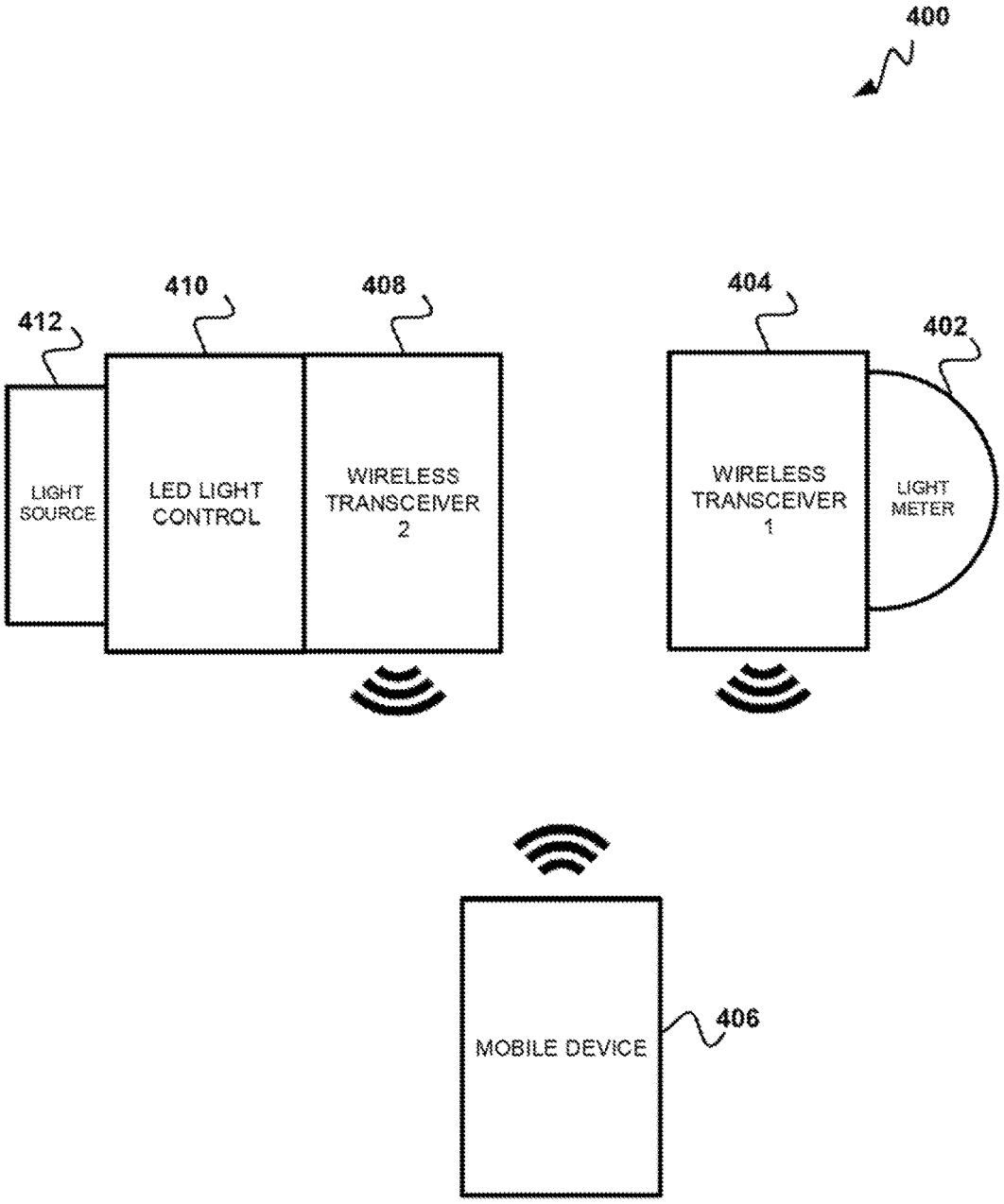
FIG. 4 illustrates a color-changing lighting system where the full spectrum LED light source is separate from a color temperature meter, where both devices include wireless transceivers that communicate with a mobile computing device.

FIG. 4 shows a color-changing lighting system 400 where the full spectrum LED light source 410 is separate from a color temperature meter 402. Additionally, both the full spectrum LED light source 410 and the color temperature meter 402 include wireless transceivers. A mobile computing device 406 wirelessly receives the color temperature reading from the color temperature meter 402. The mobile computing device 406 then implements software conversion from color temperature to RGB or CMYK. The results are wirelessly transmitted to be output by the full spectrum LED light source 410.

As shown, the color-changing lighting system 400 includes a color temperature meter 402, a first wireless transceiver 404, a mobile computing device 406, a second wireless transceiver 408, an LED light control unit 410, and a full spectrum LED light source 412. The color temperature meter 402 is connected to the first wireless transceiver 404. The color temperature meter 402 is the same as the color temperature meter described in FIG. 1. The wireless transceiver 404 is the same as the wireless transceiver described in FIG. 2. The color temperature meter 402 determines a color temperature of visible light within an environment (measured in K) and sends the color temperature to the wireless transceiver 404.

In response to receiving the color temperature, the wireless transceiver 404 transmits the color temperature to a mobile computing device 406. The mobile computing device 406 is the same as the mobile computing device described in FIG. 2.

The mobile computing device 406 converts the received color temperature into RGB (or CMYK) values, using the process described in FIG. 1. Once the mobile computing device 406 converts the received color temperature into RGB (or CMYK) values, it wirelessly sends the RGB (or CMYK) values back to a second wireless transceiver 408. The second wireless transceiver 408 is the same as the wireless transceiver described in FIG. 2.

The second wireless transceiver 408 is connected to an LED light, control unit 410 that controls a full spectrum LED light source 410. The LED light control unit 410 and the full spectrum LED light source 412 are the same as those described in FIG. 1. The second wireless transceiver 408 sends the received RGB (or CMYK) values to the LED light control unit 410. The LED light control unit 410 then calibrates the full spectrum LED light source 412 to match the received RGB (or CMYK) values. The full spectrum LED light source 412 then outputs light matching the received RGB (or CMYK) values.

Therefore, in FIG. 4 the conversion of a color temperature into RGB values is offloaded. to the mobile computing device 406. Also, the color temperature meter 402 and first wireless transceiver 404 may be located in a different area than the second wireless transceiver 404, the LED light control unit 410, and the full spectrum LED light source 410.

Figure 5:
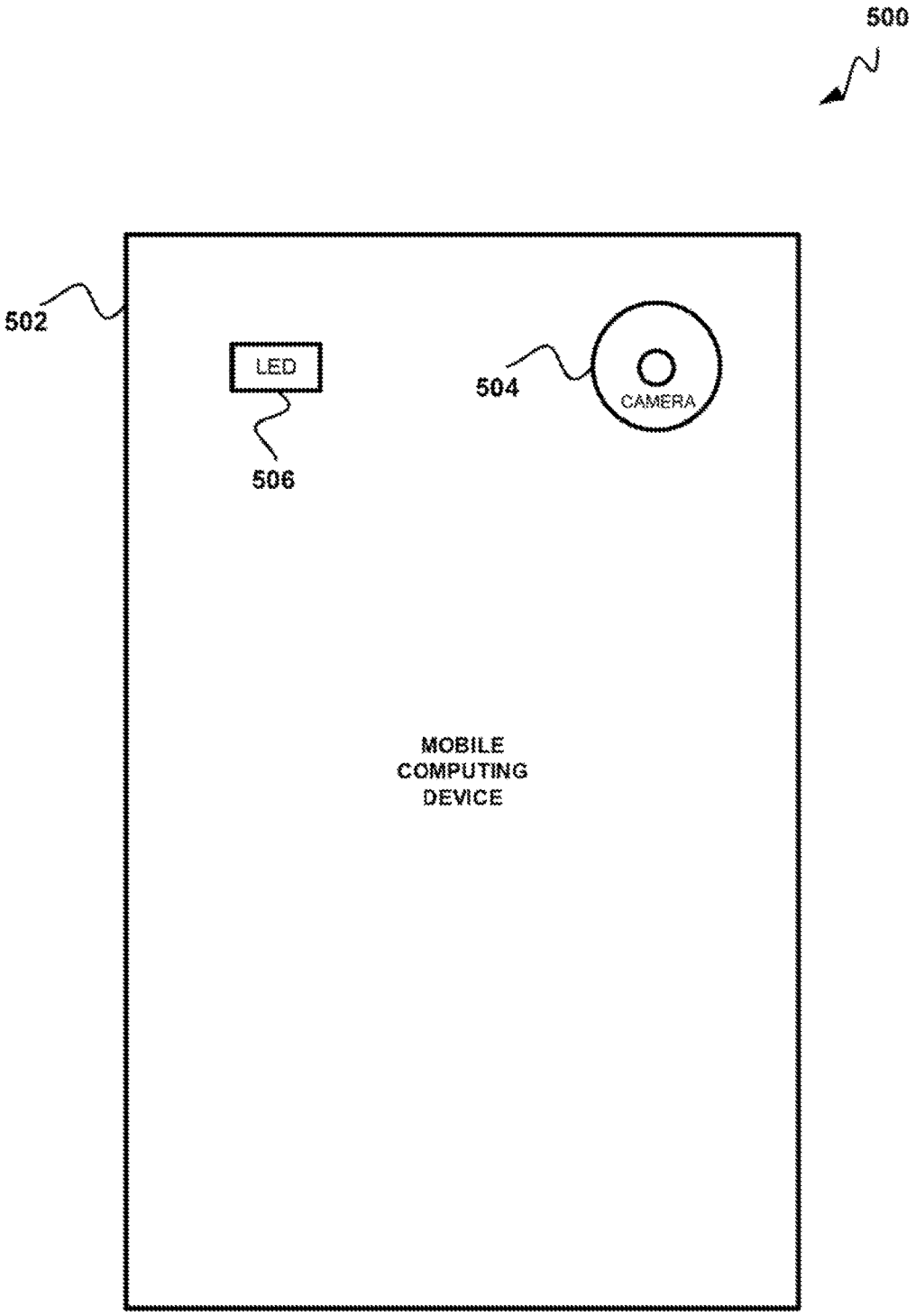
FIG. 5 illustrates a color-changing lighting system where a mobile computing device detects and alters a color temperature reading.
Figure 6:
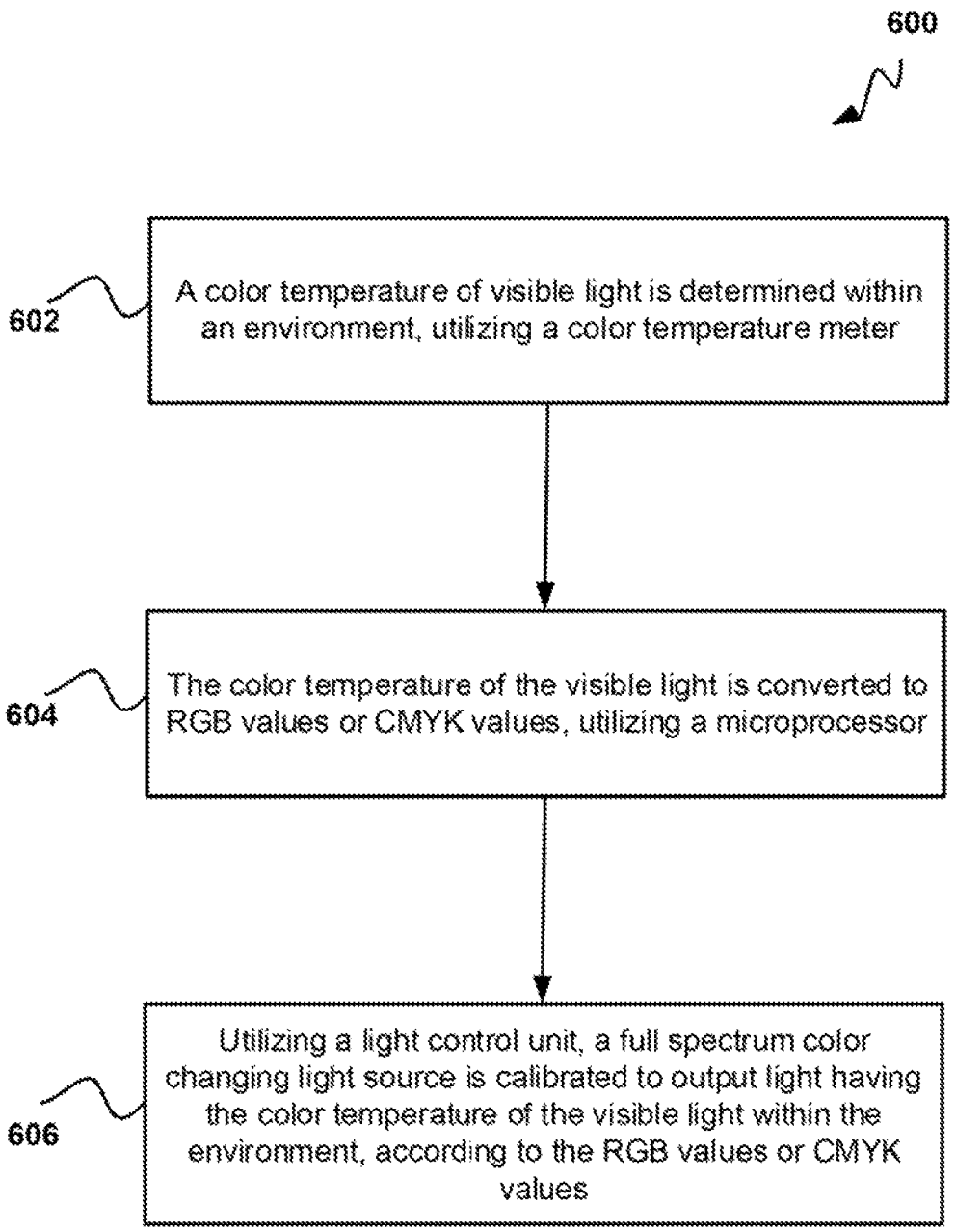
FIG. 6 describes a method for performing environmental control of output color temperature.

FIG. 5 shows a color-changing lighting system 500 where a mobile computing device 502 detects a color temperature reading. The mobile computing device 502 then converts the color temperature to RGB or CMYK. The results are output using a full spectrum LED light source 506 of the mobile device.

As shown, the mobile computing device 502 includes art onboard camera 504 and a full spectrum LED light source 506. The mobile computing device 502 is the same as the mobile computing device described in FIG. 2, with the inclusion of the onboard camera 504 (please note that the mobile computing device described in FIG. 2 may also include an onboard camera). The onboard camera 504 of the mobile computing device 502 includes any optical instrument installed within the mobile computing device 502 that is capable of recording or capturing an image utilizing visible light.

The onboard camera 504 of the mobile computing device 502 functions as a color temperature meter. For example, the onboard camera 504 determines a color temperature of visible light within an environment, in the same manner as the color temperature meter in FIG. 1. An application installed within the mobile computing device 502 then converts the received color temperature into RGB (or CMYK) values, using the process described in FIG. 1.

The full spectrum LED light source 506 includes one or more LEDs mounted within the mobile computing device 502 that electronically output light in response to instructions from the mobile computing device 502. Once the mobile computing device 502 converts the received color temperature into RGB (or CMYK) values, it calibrates the full spectrum LED tight source 506 located within the mobile computing device 502, The full spectrum LED light source 506 then outputs light matching the received RGB (or CMYK) values.

Therefore, in FIG. 5 color temperature detection, conversion, and light output are all performed by the mobile computing device 502.

FIG. 6 describes a method 600 for performing environmental control of output color temperature. As described in operation 602, a color temperature of visible light is determined within an environment, utilizing a color temperature meter. Additionally, as described in operation 604, the color temperature of the visible light is converted to RGB values or CMYK values, utilizing a microprocessor. Further, as described in operation 606, utilizing a light control unit, a full spectrum color changing light source is calibrated to output light having the color temperature of the visible light within the environment, according to the RGB values or CMYK values.

Therefore, in FIG. 6 a color temperature of visible light that is output by a device is adjusted to match a color temperature of the visible light in an environment surrounding the device.

It will be understood that many additional changes in the details, materials, steps and arrangement of parts, which have been herein described and illustrated to explain the nature of the invention, may be made by those skilled in the art within the principle and scope of the invention as expressed in the appended claims.

The foregoing description of various embodiments have been presented for purposes of illustration and description. It is not intended to be exhaustive or to limit the invention to the precise forms disclosed, and obviously many modifications and variations are possible in light of the above teaching. The example embodiments, as described above, were chosen and described in order to best explain the principles of the invention and its practical application to thereby enable others skilled in the an to best utilize the invention in various embodiments and with various modifications as are suited to the particular use contemplated. It is intended that the scope of the invention be defined by the claims appended hereto.

The invention claimed is:

1. A color-changing lighting system, including:

a color temperature meter for determining a color temperature of visible light within an environment;

a microprocessor for converting the color temperature of the visible light to red, green, and blue values, wherein the microprocessor is located within a mobile computing device that communicates wirelessly with the color temperature meter; and a light control unit for calibrating a full spectrum color changing light source to output light having the color temperature of the visible light within the environment, according to the red, green, and blue values from the microprocessor.

2. The system of claim 1, wherein the microprocessor and the light control unit are directly connected.

3. The system of claim 1, wherein the microprocessor and the light control unit are not directly connected and communicate utilizing one or more wireless transceivers.

4. The system of claim 1, wherein the color temperature meter includes a camera.

5. The system of claim 1, wherein the full spectrum color changing light source emits constant light, strobing light, or a flash of light.

6. The system of claim 1, wherein the microprocessor further converts the color temperature of the visible light from red, green, and blue values into cyan, magenta, yellow, and black values.

7. The system of claim 1, wherein the microprocessor searches a database for the color temperature of visible light within the environment, and results of the search contain the red, green, and blue values.

8. A color-changing lighting system, including:

a color temperature meter for determining a color temperature of visible light within an environment;

a microprocessor for converting the color temperature of the visible light to red, green, and blue values, wherein the microprocessor includes a first wireless transceiver; and a light control unit for calibrating a full spectrum color changing light source to output light having the color temperature of the visible light within the environment, according to the red, green, and blue values from the microprocessor, wherein the light control unit includes a second wireless transceiver, where the first wireless transceiver and the second wireless transceiver communicate wirelessly.

9. A method, comprising:

determining a color temperature of visible light within an environment, utilizing a color temperature meter;

converting the color temperature of the visible light to red, green, and blue values, utilizing a microprocessor, wherein the microprocessor is located within a mobile computing device that communicates wirelessly with the color temperature meter; and calibrating, utilizing a light control unit, a full spectrum color changing light source to output light having the color temperature of the visible light within the environment, according to the red, green, and blue values from the microprocessor.

10. The method of claim 9, wherein the microprocessor and the light control unit are directly connected.

11. The method of claim 9, wherein the microprocessor and the light control unit are not directly connected and communicate utilizing one or more wireless transceivers.

12. The method of claim 9, wherein the color temperature meter includes a camera.

13. The method of claim 9, wherein the full spectrum color changing light source emits constant light, strobing light, or a flash of light.

14. The method of claim 9, further comprising converting the color temperature of the visible light from red, green, and blue values into cyan, magenta, yellow, and black values.

15. The method of claim 9, wherein the microprocessor searches a database for the color temperature of visible light within the environment, and results of the search contain the red, green, and blue values.

* * * * *